US007922446B2

(12) United States Patent
Bei et al.

(10) Patent No.: US 7,922,446 B2
(45) Date of Patent: Apr. 12, 2011

(54) COOLING FAN WITH BALANCE STRUCTURE

(75) Inventors: Li Bei, Shenzhen (CN); Zhi-Cheng Yang, Shenzhen (CN); Yong-Kang Zhang, Shenzhen (CN); Ying-Min Huang, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 918 days.

(21) Appl. No.: 11/778,545

(22) Filed: Jul. 16, 2007

(65) Prior Publication Data

US 2009/0022611 A1 Jan. 22, 2009

(51) Int. Cl.

| | |
|---|---|
| ***F04D 29/046*** | (2006.01) |
| ***F04D 29/048*** | (2006.01) |
| ***F04B 17/03*** | (2006.01) |
| ***H02K 7/09*** | (2006.01) |

(52) U.S. Cl. ..... 415/229; 416/174

(58) Field of Classification Search ..... 415/229; 416/174

See application file for complete search history.

(56) References Cited

U.S. PATENT DOCUMENTS

| | | | | |
|---|---|---|---|---|
| RE35,718 | E * | 1/1998 | Nii et al. | 384/133 |
| 6,921,996 | B2 | 7/2005 | Parsoneault et al. | |
| 7,145,275 | B2 * | 12/2006 | Yang et al. | 310/90.5 |
| 2005/0157963 | A1 * | 7/2005 | Oelsch | 384/100 |
| 2006/0255674 | A1 * | 11/2006 | Chen et al. | 310/90 |
| 2007/0024137 | A1 | 2/2007 | Otsuki et al. | |
| 2008/0238228 | A1 * | 10/2008 | Chang et al. | 310/90 |

FOREIGN PATENT DOCUMENTS

| | | |
|---|---|---|
| TW | M296587 | 8/2006 |

* cited by examiner

*Primary Examiner* — Edward Look
*Assistant Examiner* — Jesse Prager
(74) *Attorney, Agent, or Firm* — Jeffrey T. Knapp

(57) ABSTRACT

A cooling fan includes a fan housing (30) having a central tube (34) extending upwardly therefrom; the central tube has a bottom, annular protrusion (31). A bearing (61) is received in the central tube and mounted on the protrusion. A stator (20) is mounted around the central tube. A rotor (10) includes a shaft (18) having a free end (186) extending through the bearing and defining a notch (184) therein. A locking washer (63) engages into the notch of the shaft to limit movement of the shaft along an axial direction thereof. A balance structure (62) is arranged between the locking washer and the bearing. The balance structure is made of magnet and exerts a downwardly pulling force on the shaft to prevent the rotor from moving upwardly when the rotor is rotated.

14 Claims, 6 Drawing Sheets

COOLING FAN WITH BALANCE STRUCTURE

BACKGROUND OF THE INVENTION

1. Field of the Invention

The present invention relates to a cooling fan, and more particularly relates to a cooling fan with a balance structure for maintaining stable rotation of a rotor thereof.

2. Description of Related Art

With the continuing development of the electronic technology, electronic packages such as CPUs (central processing units) are generating more and more heat that requires immediate dissipation. Cooling fans are commonly used in combination with heat sinks for cooling the CPUs.

A conventional cooling fan includes a stator and a rotor having a hub with a plurality of fan blades extending therefrom. The stator establishes an alternating magnetic field interacting with the magnetic field of the rotor to drive the rotor to rotate. Thus rotation of the fan blades generates a forced airflow for cooling the electronic packages, such as the CPUs. The stator includes a bearing defining a bearing hole therein. The rotor has a shaft extending into the bearing hole and is thus rotatably supported by the bearing. However, during rotation of the rotor, the rotating fan blades generate an external pressure which pulls the rotor to move upwardly along the axial direction away from the stator, whereby the rotor is in a somewhat "floating" condition. The floating rotor is inclined to generate a level of noise, which sometimes is unacceptable.

For the foregoing reasons, therefore, there is a need in the art for a cooling fan which overcomes the above-mentioned problems.

SUMMARY OF THE INVENTION

According to a preferred embodiment of the present invention, a cooling fan includes a fan housing having a central tube extending upwardly therefrom, the central tube having an annular protrusion extending inwardly from a bottom end thereof. A bearing is received in the central tube and mounted on the protrusion of the central tube. A stator is mounted around the central tube. A rotor includes a shaft having a free end extending through the bearing. The free end of the shaft defines a notch therein. A locking washer engages into the notch of the shaft to limit movement of the shaft along an axial direction thereof. A balance structure is arranged between the locking washer and the bearing. The balance structure has a portion facing the notch of the shaft. The balance structure is made of magnetic material, which can attract the shaft downward to thereby counter the upward force generated by the rotor when it is driven to rotate. Accordingly, the noise problem incurred by the floating of the rotating rotor can be resolved by the present invention.

Other advantages and novel features of the present invention will be drawn from the following detailed description of the preferred embodiments of the present invention with attached drawings, in which:

BRIEF DESCRIPTION OF THE DRAWINGS

Many aspects of the present cooling fan can be better understood with reference to the following drawings. The components in the drawings are not necessarily drawn to scale, the emphasis instead being placed upon clearly illustrating the principles of the present cooling fan. Moreover, in the drawings, like reference numerals designate corresponding parts throughout the several views.

DETAILED DESCRIPTION OF THE INVENTION

Figure 1:
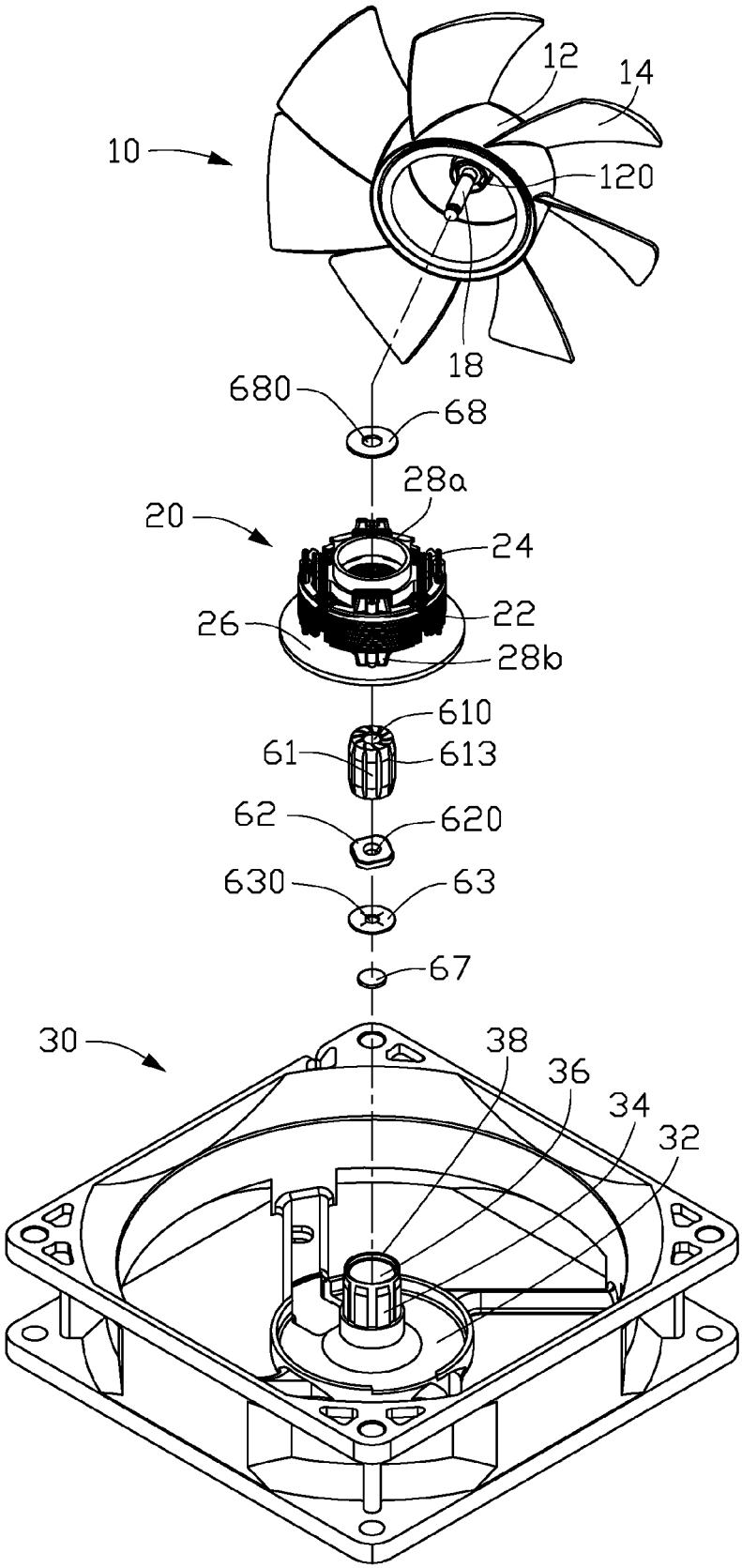
FIG. 1 is an isometric, exploded view of a cooling fan in accordance with a preferred embodiment of the present invention.
Figure 2:
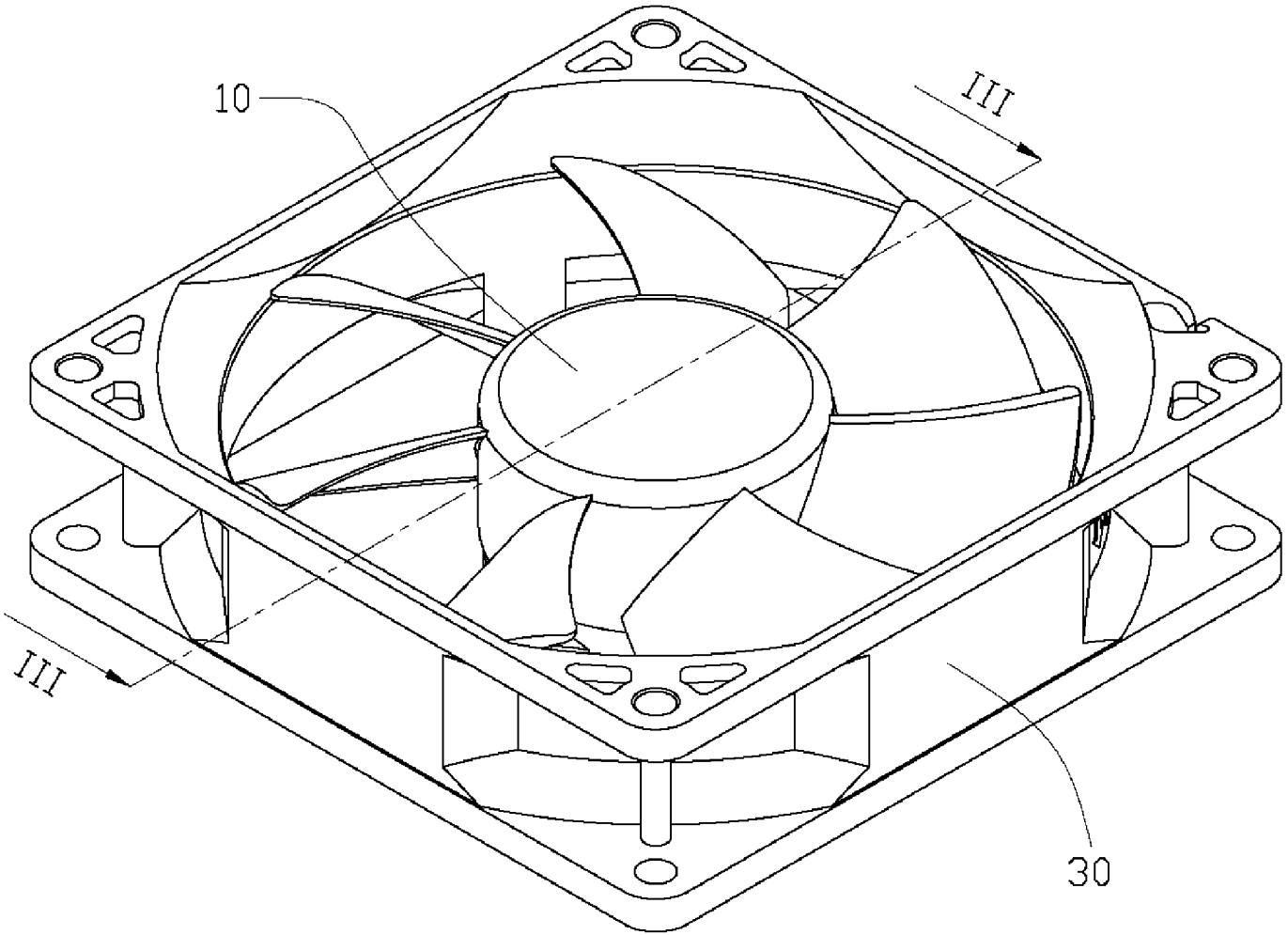
FIG. 2 is an isometric, assembled view of the cooling fan of FIG. 1.
Figure 3:
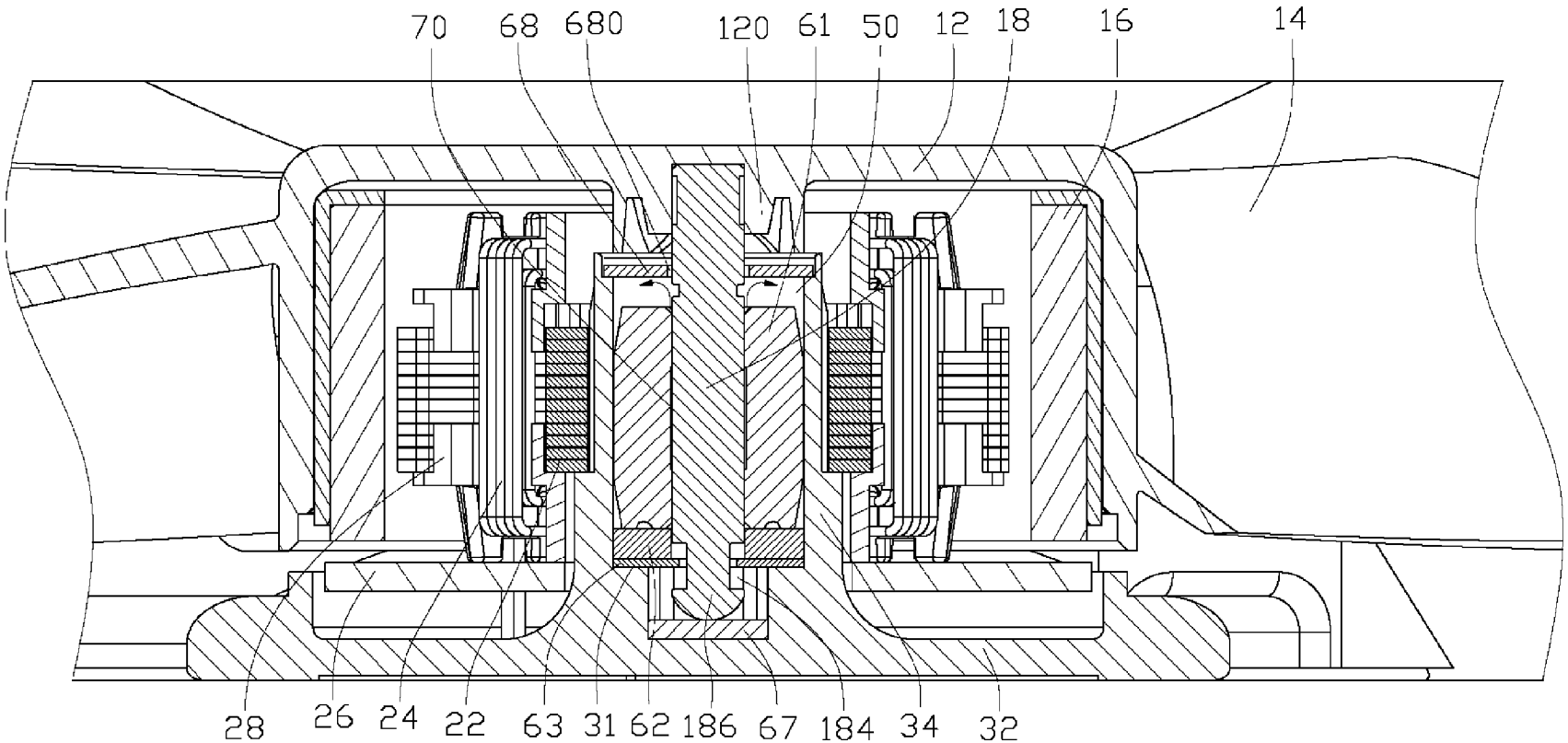
FIG. 3 is a cross-sectional view of the cooling fan taken along line III-III of FIG. 2.

Referring to FIGS. 1 through 3, a cooling fan according to a preferred embodiment includes a fan housing 30, a balance structure 62, a bearing 61, a rotor 10, and a stator 20 in respective to which the rotor 10 is rotatable.

The fan housing 30 includes a base 32 and a central tube 34 extending upwardly from a central portion of the base 32. The central tube 34 defines a central hole 36 therein and forms an open end at a top portion thereof. An annular recess 38 is formed on an inner circumference of the top portion of the central tube 34. The recess 38 communicates with the central hole 36. Thus the top portion of the central tube 34 has an inner diameter larger than that of the other portion of the central tube 34. A bottom end of the central tube 34 is closed. An annular protrusion 31 extends inwardly from the inner circumference of a bottom end of the central tube 34, and thus forms a step in the central hole 36 at the bottom end of the central tube 34.

The rotor 10 includes a hub 12 forming a shaft seat 120 in a central portion thereof, a plurality of fan blades 14 extending radially from an outer periphery of the hub 12, a permanent magnet 16 adhered to an inner side of the hub 12, and a shaft 18 received in the shaft seat 120 and extending downwardly from a central portion of the shaft seat 120. An annular notch 184 is defined near a free end 186 of the shaft 18 far from the hub 12.

The stator 20 includes a stator core consisting of layered yokes 22. Each yoke 22 includes an annular main body and four claws extending radially and outwardly from the main body. Stator coils 24 wind on the claws of the stator core to establish an alternating magnetic field. A PCB 26 (Printed Circuit Board) with electronic components mounted thereon is electrically connected with the stator coils 24 to control electrical current flowing through the coils 24. To avoid the coils 24 from coming into electrical contact with the stator core, an insulating frame 28 including upper and lower insulating frames 28*a*, 28*b* is used to cover the stator core and electrically insulate the stator coils 24 from the stator core.

The bearing 61 is received in the central hole 36 of the central tube 34. The bearing 61 defines a bearing hole 610 therein for extension of the shaft 18 therethrough. A middle portion of the bearing hole 610 of the bearing 61 has a diameter being larger than that of the top and bottom ends of the bearing hole 610 and the outer diameter of the shaft 18. When the fan is assembled, a narrow clearance is defined between each end of the bearing 61 and the shaft 18 for reducing oil loss of the cooling fan, and a space 70 is defined between the middle portion of the bearing 61 and the shaft 18 for improving the supply of lubrication oil to the bearing 61. Thus the contacting area between the bearing 61 and the shaft 18 is reduced, thereby reducing the friction generated between the bearing 61 and the shaft 18. A plurality of channels 613 communicating with the bearing hole 610 are defined in an outer surface of the bearing 61 for allowing the lubricant oil to flow back into the bearing 61.

Figure 4:
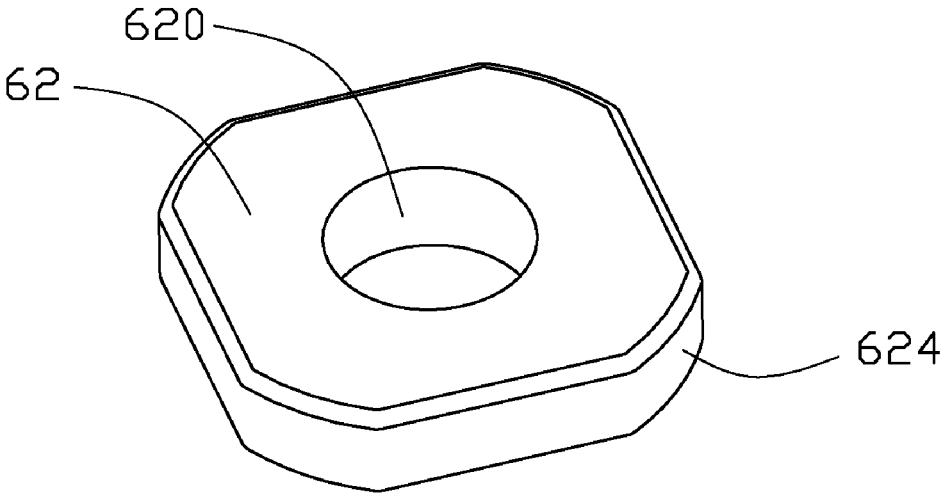
FIG. 4 is an enlarged, isometric view of a balance structure of the cooling fan of FIG. 1.
Figure 5:
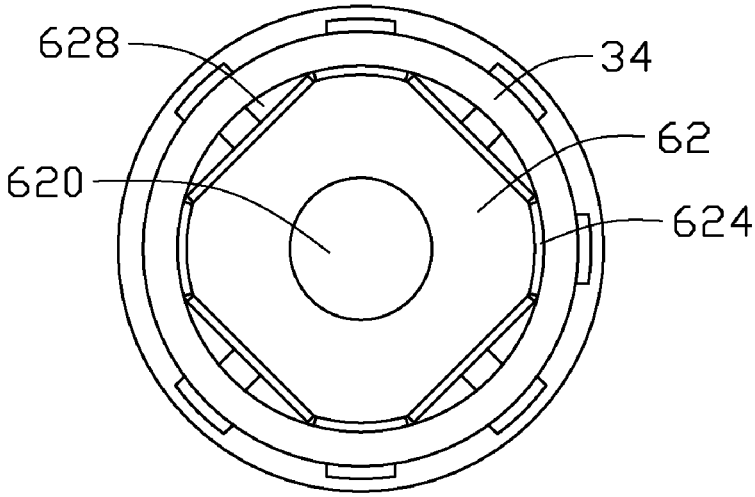
FIG. 5 is a top view of the balance structure mounted in a central tube of the cooling fan of FIG. 1.

Referring to FIGS. 4-5, the balance structure 62 is a permanent magnet and has a shape being approximately square column. A through hole 620 with a diameter being approximately the same as the outer diameter of the shaft 18 is defined in a central portion of the balance structure 62. Each of four corners of the balance structure 62 forms a chamfer angle 624. The chamfer angle 624 has a radius of curvature approximately the same as a radius of the central hole 36 of the central tube 34. When the balance structure 62 is mounted into the central hole 36, the four chamfer angles 624 conformably abut an inner surface of the central tube 34, thus fixing the balance structure 62 into the central tube 34. The four sides of the balance structure 62 are spaced from the inner surface of the central tube 34 and thus define a gap 628 between each side of the balance structure 62 and the inner surface of the central tube 34.

When assembled, the stator 20 is mounted around the central tube 34. The bearing 61 is received in the central hole 36 of the central tube 34 and is arranged over the protrusion 31. The top end of the bearing 61 is lower than the top of the central tube 34. An oil-retaining ring 68 is received in the recess 38 of the central tube 34 and mounted around the shaft 18 for sealing the bearing 61 in the central tube 34. The oil-retaining ring 68 defines a circular hole 680 for extension of the shaft 18 therethrough. An oil buffer 50 is thus defined between the central tube 34, the shaft 18, the oil-retaining ring 68 and the bearing 61. The oil buffer 50 communicates with the channels 613 and the bearing hole 610 of the bearing 61. The free end 186 of the shaft 18 extends through the bearing hole 610 of the bearing 61 into the central tube 34. A wear pad 67 made of highly abrasion resistant material is mounted in a bottom end of the central hole 36 of the central tube 34 to face and supportively engage the free end 186 of the rotary shaft 18. The notch 184 of the shaft 18 is located under the bottom end of the bearing 61. A locking washer 63 is located under the bottom end of the bearing 61 and is arranged on the protrusion 31 of the central tube 34. The locking washer 63 defines an inner hole 630 with a diameter smaller than the diameter of the shaft 18, but larger than the diameter of the portion of the shaft 18 defining the notch 184. Thus the locking washer 63 is engaged in the notch 184 to limit movement of the shaft 18 along an axial direction thereof.

The balance structure 62 is mounted into the central hole 36 and arranged between the bottom end of the bearing 61 and the locking washer 63. The four chamfer angles 624 abut the inner surface of the central tube 34, and the four sides of the balance structure 62 are spaced from the inner surface of the central tube 34. The gaps 628 between the sides of the balance structure 62 and the inner surface of the central tube 34 communicate with the channels 613 of the bearing 61. A top of the balance structure 62 is located higher than the portion of the shaft 18 defining the notch 184. A bottom of the balance structure 62 is located corresponding to a middle of the notch 184. In other words, the balance structure 62 has a lower portion facing an upper portion of the notch 184 of the shaft 18, and has an upper portion faces a portion of the shaft 18 near and upon the top of the notch 184. In this embodiment, the upper half of the balance structure 62 faces the portion of the shaft 18 near and upon the top of the notch 184, and the lower half of the balance structure 62 faces the upper half of the notch 184 of the shaft 18. Alternatively, the lower portion of the balance structure 62 facing the notch 184 can be less than half of the balance structure 62, and thus the upper portion of the balance structure 62 facing the shaft 18 can be larger than half of the balance structure 62.

During operation, the rotor 10 is driven to rotate by the interaction of the alternating magnetic field established by the stator 20 and the magnetic field of the rotor 10. The lubrication oil creeps up along the rotating shaft 18 under the influence of the centrifugal force generated by the rotation of the shaft 18 and then escapes to the oil buffer 50 through the clearance defined between the top end of the bearing 61 and the shaft 18. The oil-retaining ring 68 sufficiently prevents the oil from leaking out so that the escaping oil is received in the buffer 50 and then flows back to the bearing 61 through the channels 613 and the gaps 628. Good lubrication of the bearing 61 and shaft 18 is thus constantly maintained, thereby enabling the cooling fan to run smoothly, stably and with less vibration. Furthermore, as the lower portion of the balance structure 62 facing the notch 184 and the upper portion of the balance structure 62 facing the shaft 18, an annular interspace is defined between the lower portion of the balance structure 62 and the upper portion of the notch 184 of the shaft 18. The balance structure 62 can generate a magnetic attraction force acting on the shaft 18 along the axial direction. When rotation of the rotor 10 generating an external pressure pulls the rotor 10 upwardly along the axial direction thereof, the balance structure 62 can magnetically attract the shaft 18 and pull the shaft 18 downwardly along the axial direction. Thus the axially upward movement and possible floating of the rotor 10 during rotation of the cooling fan is avoided, and thus the problem of the noise generated by the floating of the rotor 10 and the possible collision between the free end 186 of the shaft 18 and the wear pad 67 during an unstable period of the floating of the rotor 10 can be solved by the present invention.

Figure 6:
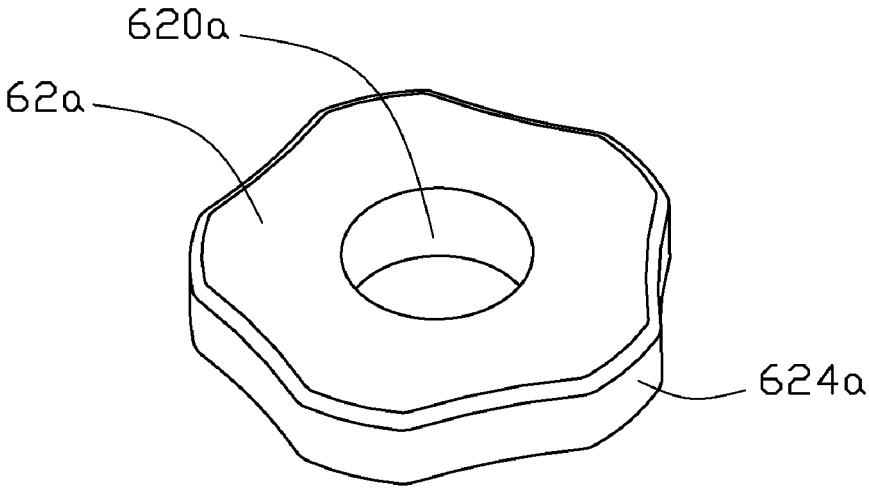
FIG. 6 shows an isometric view of the balance structure in accordance with an alternative embodiment of the present invention.

FIG. 6 shows an alternative embodiment of the balance structure 62*a*. Similar to the first embodiment, the balance structure 62*a* is column shaped and defines a central hole 620*a*. The difference of the second embodiment over the first embodiment is that the balance structure 62*a* has a pentagonal-shaped cross section. Also each of the five corners of the balance structure 62*a* forms a chamfer angle 624*a*. When the balance structure 62*a* is mounted into the central hole 36 of the central tube 34, the five chamfer angles 624*a* abut the inner surface of the central tube 34, and the five sides of the balance structure 62*a* are spaced from the inner surface of the central tube 34. It can be understood that the balance structure 62, 62*a* is not limited to having four sides or five sides as previously discussed, it can also have six or more sides. Alternatively, the balance structure 62, 62*a* is not limited to being square column-shaped, it can also be cylindrical-shaped.

It is understood that the invention may be embodied in other forms without departing from the spirit thereof. Thus, the present example and embodiment are to be considered in all respects as illustrative and not restrictive, and the invention is not to be limited to the details given herein.

What is claimed is:

1. A cooling fan comprising:

a fan housing having a central tube extending upwardly therefrom;

a bearing received in the central tube, the bearing defining a bearing hole therein and a plurality of channels in an outer circumferential surface thereof;

a stator mounted around the central tube;

a rotor comprising a hub having a shaft extending therefrom, the shaft having a free end far from the hub, the free end of the shaft extending through the bearing hole of the bearing and defining a notch therein; and a balance structure being mounted around the shaft with a top higher than the notch of the shaft and a lower portion facing an upper portion of the notch, the balance structure exerting a downwardly attractive, magnetic force on the shaft, wherein the balance structure is column shaped, a cross section of the balance structure is polygonal-shaped, and a gap is defined between each side of the balance structure and an inner circumferential surface of the central tube, the gap communicating with the channels of the bearing.

2. The cooling fan as claimed in claim 1, wherein a lower half of the balance structure faces an upper half of the notch.

3. The cooling fan as claimed in claim 1, wherein each corner of the balance structure forms a chamfer angle abutting the inner circumferential surface of the central tube.

4. The cooling fan as claimed in claim 3, wherein each chamfer angle has a radius of curvature approximately the same as an inner radius of the central tube.

5. The cooling fan as claimed in claim 3, wherein the cross section of the balance structure is one of square-shaped and pentagonal-shaped.

6. The cooling fan as claimed in claim 1, wherein the central tube has an annular protrusion extending inwardly from a bottom end thereof, the bearing is arranged on the protrusion of the central tube, and the balance structure is arranged between the protrusion and the bearing.

7. The cooling fan as claimed in claim 6, further comprising a locking washer engaged in the notch of the shaft to limit movement of the shaft along an axial direction thereof, the locking washer being arranged between the protrusion of the central tube and the balance structure.

8. The cooling fan as claimed in claim 1, wherein the balance structure is a permanent magnet.

9. A cooling fan, comprising:

a fan housing having a central tube extending upwardly therefrom, the central tube having an annular protrusion extending inwardly from a bottom end thereof;

a bearing received in the central tube and mounted on the protrusion of the central tube, the bearing defining a plurality of channels in an outer circumferential surface thereof;

a stator mounted around the central tube;

a rotor comprising a shaft having a free end extending through the bearing, the free end defining a notch therein;

a locking washer arranged between the protrusion of the central tube and the bearing, the locking washer engaging into the notch of the shaft to limit movement of the shaft along an axial direction thereof; and a balance structure being arranged between the locking washer and the bearing, the balance structure having a portion facing the notch of the shaft, the balance structure exerting a downwardly attractive, magnetic force on the shaft, wherein the balance structure is column shaped, a cross section of the balance structure is polygonal-shaped, and a gap is defined between each side of the balance structure and an inner circumferential surface of the central tube, the gap communicating with the channels of the bearing.

10. The cooling fan as claimed in claim 9, wherein a top of the balance structure is higher than the notch, a lower half of the balance structure facing an upper half of the notch.

11. The cooling fan as claimed in claim 9, wherein each corner of the balance structure forms a chamfer angle abutting the inner circumferential surface of the central tube.

12. The cooling fan as claimed in claim 11, wherein each chamfer angle has a radius of curvature approximately the same as an inner radius of the central tube.

13. The cooling fan as claimed in claim 11, wherein the cross section of the balance structure is one of square-shaped and pentagonal-shaped.

14. The cooling fan as claimed in claim 9, wherein the balance structure is a permanent magnet.

* * * * *